US006164793A

United States Patent [19]

Wu

[11] Patent Number: 6,164,793

[45] Date of Patent: Dec. 26, 2000

[54] REFRACTIVE COASTER

[76] Inventor: Hui-Ming Wu, P.O. Box 82-144, Taipei, Taiwan

[21] Appl. No.: 09/451,429

[22] Filed: Nov. 30, 1999

[51] Int. Cl.[7] ..... F21V 33/00

[52] U.S. Cl. ..... 362/101; 362/806

[58] Field of Search ..... 362/96, 101, 154, 362/155, 276, 328, 806, 800, 299; 248/346.11; 200/85 R

[56] References Cited

U.S. PATENT DOCUMENTS

| | | | |
|---|---|---|---|
| 4,261,026 | 4/1981 | Bolha | 362/101 |
| 4,858,084 | 8/1989 | Sheryll | 362/154 |
| 5,010,461 | 4/1991 | Saotome | 362/101 |

*Primary Examiner*—Y. Quach
*Attorney, Agent, or Firm*—A & J

[57] ABSTRACT

A refractive coaster includes a bottom cover, a circular seat mounted on the bottom cover, a plurality of batteries fitted inside the seat, a printed circuit board arranged on the bottom cover and electrically connected with the batteries and provided with an annular ring-like electrode and a plurality of light-emitting members, a conducting pin having an immediate portion formed with a flange and having a lower end extending downwardly through the annular ring-like electrode, a spring fitted on an upper end of the conducting pin and urging the lower end of the conducting pin to move downwardly out the bottom cover, a bowl-shaped base made of transparent material and having an opening at a central portion thereof and a mirrored surface at an upper side thereof, the bowl shaped base being fitted in the circular seat with the light-emitting members protruding upwardly out of the opening, a circular lid made of transparent material and arranged on the base and having a bottom side formed with a mirrored surface and plurality of protuberances at a central portion of the bottom side, the circular lid being arranged on the bowl-shaped base.

1 Claim, 4 Drawing Sheets

REFRACTIVE COASTER

BACKGROUND OF THE INVENTION

1. Field of the Invention

This invention is related to a refractive coaster and in particular to one that can mix lights of different colors to form a fascinating colorful light when a glass is slightly moved upwardly therefrom.

2. Description of the Prior Art

The conventional coaster is simply a thin object on which one put a glass, or cup, to protect a table from heat or liquids. However, such a coaster is too dull in function to satisfy the consumer's needs.

Therefore, it is an object of the present invention to provide a refractive coaster which will mix lights of different colors to form a fascinating colorful light when a glass is slightly moved upwardly from the coaster.

SUMMARY OF THE INVENTION

This invention is related to a refractive coaster and in particular to one that can mix lights of different colors to form a fascinating colorful light when a glass is slightly moved upwardly therefrom.

According to a preferred embodiment of the present invention, the refractive coaster includes a bottom cover, a circular seat mounted on the bottom cover, a plurality of batteries fitted inside the seat, a printed circuit board arranged on the bottom cover and electrically connected with the batteries and provided with an annular ring-like electrode and a plurality of light-emitting members, a conducting pin having an immediate portion formed with a flange and having a lower end extending downwardly through the annular ring-like electrode, a spring fitted on an upper end of the conducting pin and urging the lower end of the conducting pin to move downwardly out the bottom cover, a bowl-shaped base made of transparent material and having an opening at a central portion thereof and a mirrored surface at an upper side thereof, the bowl shaped base being fitted in the circular seat with the light-emitting members protruding upwardly out of the opening, a circular lid made of transparent material and arranged on the base and having a bottom side formed with a mirrored surface and plurality of protuberances at a central portion of the bottom side, the circular lid being arranged on the bowl-shaped base.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 5 is a sectional view illustrating how the refractive coaster is switched on.

DETAILED DESCRIPTION OF THE PREFERRED EMBODIMENT

Figure 1:
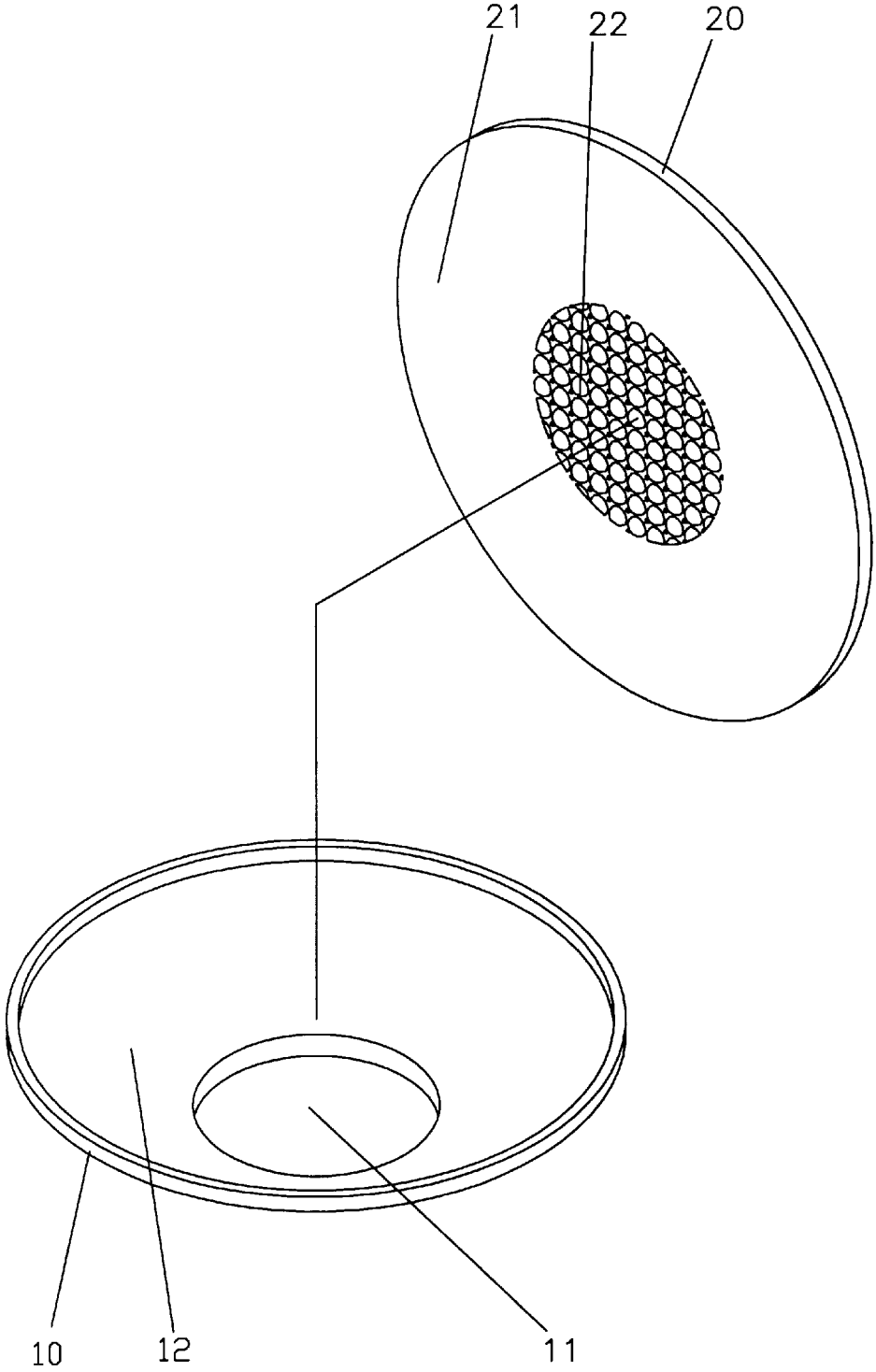
FIG. 1 is an exploded view of the refractor according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
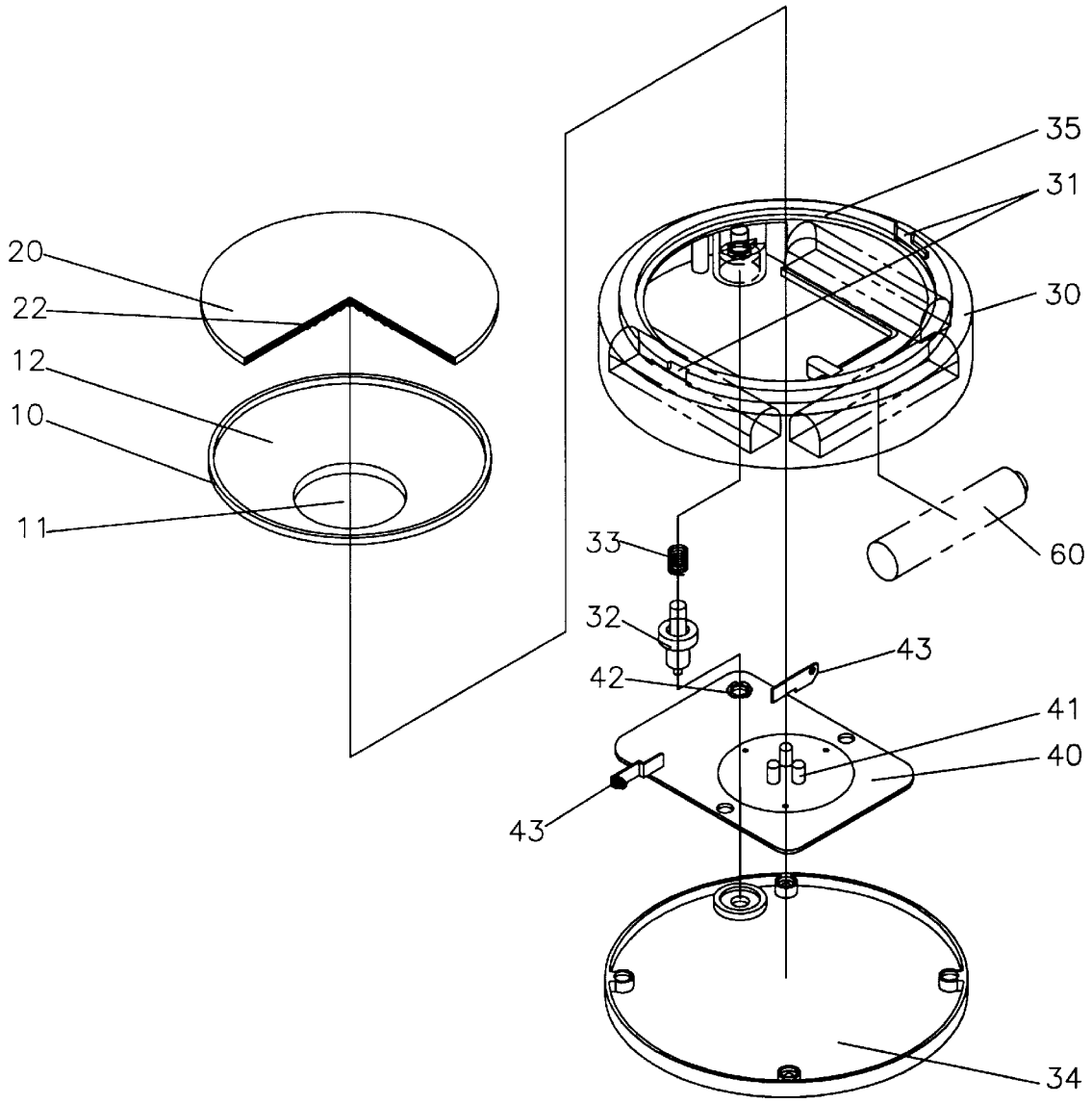
FIG. 2 is an exploded view of the refractive coaster according to the present invention.

With reference to the drawings and in particular to FIGS. 1 and 2 thereof, the refractive coaster according to the present invention generally comprises a refractor composed of a base 10 and a lid 20, a bottom cover 34, a printed circuit board 40, a seat 30, a conducting pin 30, and a spring 33.

The base 10 is a bowl-shaped member having an opening 11 at the central portion and provided with a mirrored surface 12 at the upper side. The lid 20 is a circular member arranged on the base 10 and formed with a plurality of protuberances 22 at the central portion of its bottom side 21. The base 10 and the lid 20 are made of transparent material.

Figure 3:
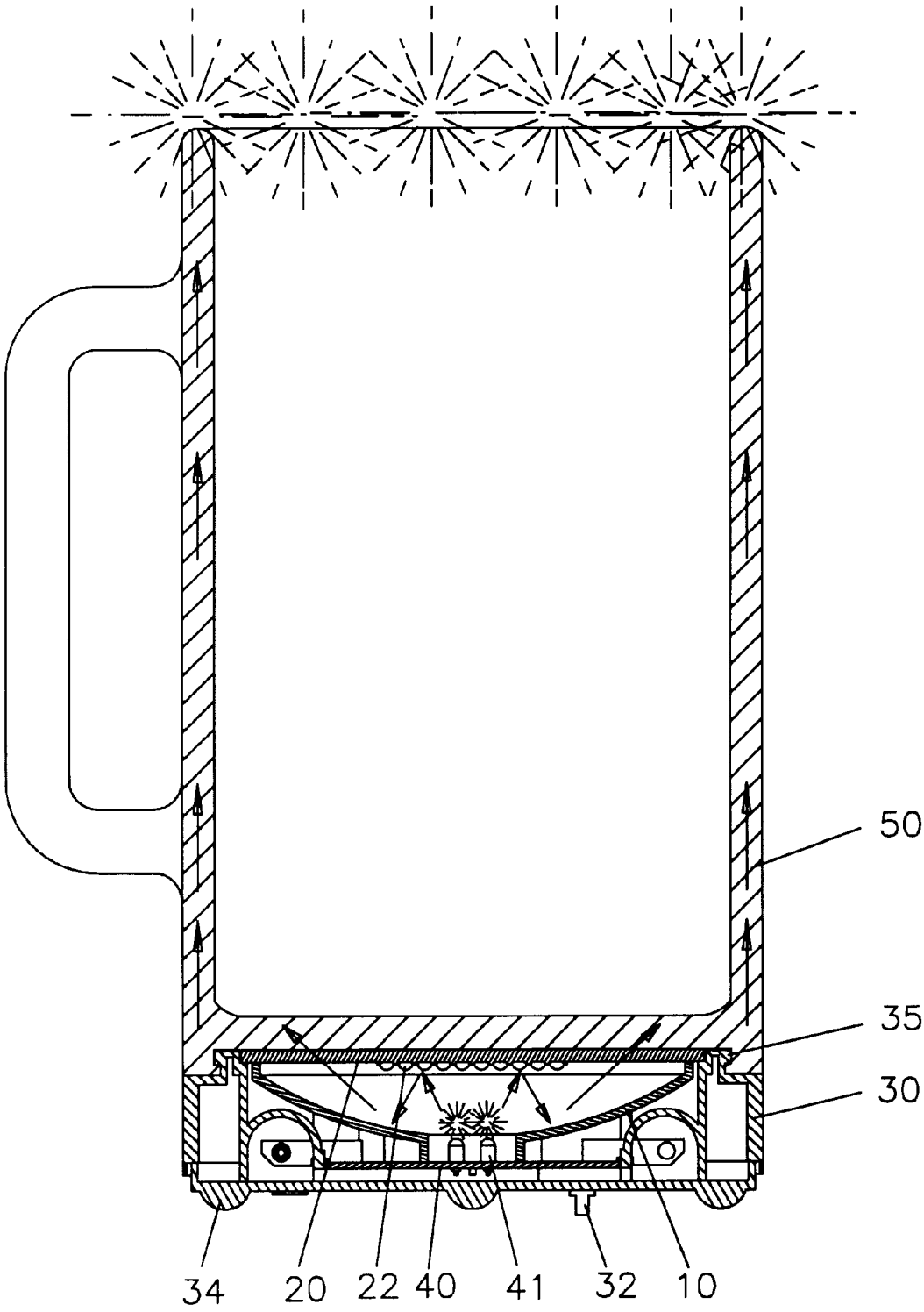
FIG. 3 is a sectional view of the refractive coaster according to the present invention.

Referring to FIGS. 2 and 3, the seat 30 is a circular casing which is open at the top and bottom. A plurality of batteries 60 are fitted inside the seat 30. The seat 30 is mounted on the bottom cover 34. The printed circuit board 40 is engaged with the bottom cover 34 and provided with a plurality of light emitting members 41. Further, the printed circuit board 40 is provided with an annular ring-like electrode 42 and two contact members 43, so that when the circular casing 30 is mounted on the bottom cover 34, the batteries 60 will be electrically connected with the printed circuit board 40. The conducting pin 32 has a flange at the intermediate portion and is fitted in the electrode 42 with its lower end extending downwardly out of the bottom cover 34. The spring 33 is fitted on the upper end of the conducting pin 32 to force the conducting pin 32 to go downwardly. The refractor is disposed in the seat 30, with the light-emitting members 41 protruding upwardly through the opening 11 of the base 10.

Figure 4:
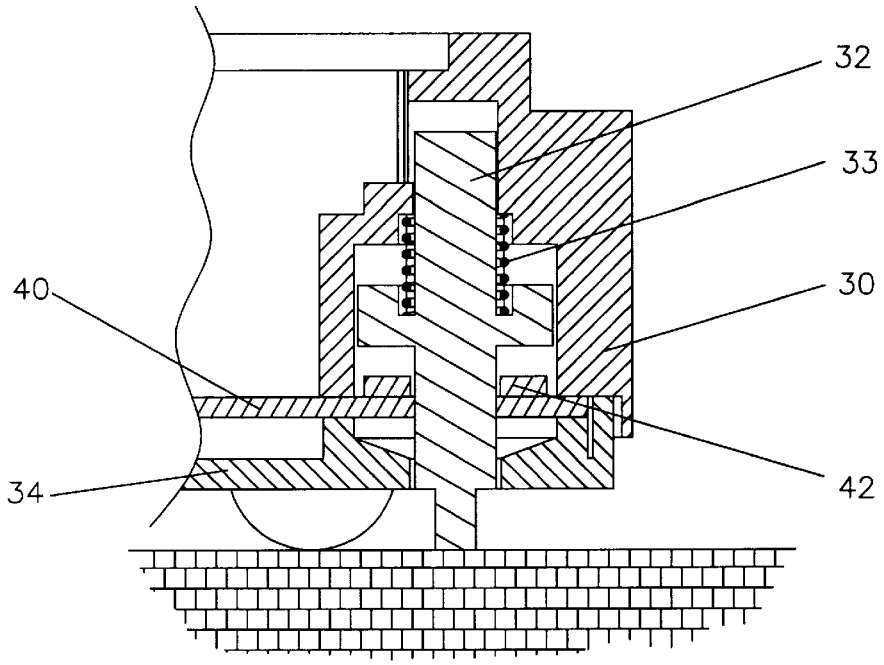
FIG. 4 is a sectional view illustrating how the refractive coaster is switched off.
Figure 5:
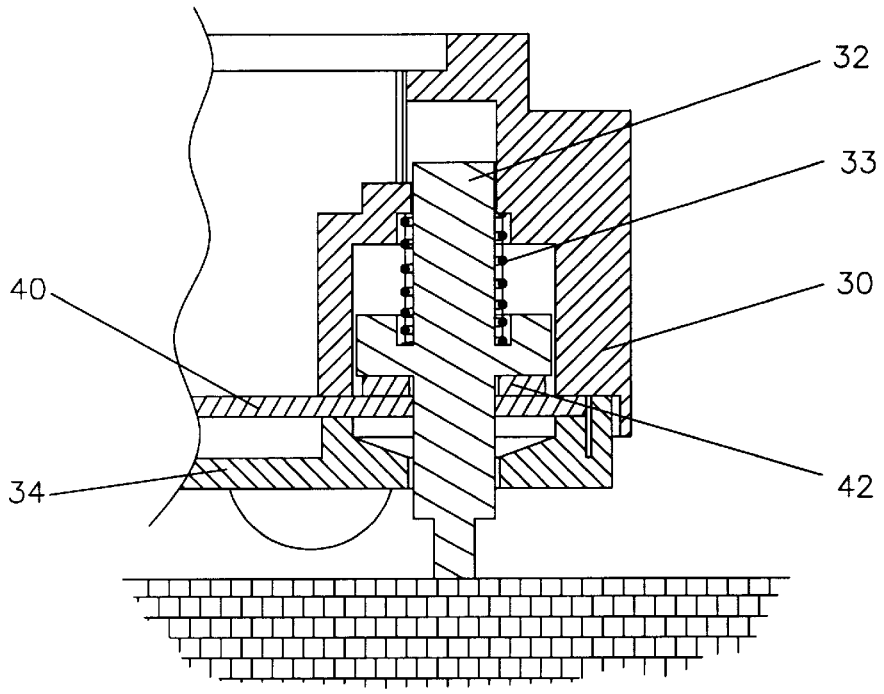

Turning to FIGS. 3, 4 and 5, when a glass 50 is placed on the refractive coaster according to the present invention, the conducting pin 32 will be forced to move upwardly with respect to the seat 30 thereby separating the conducting pin 32 from the electrode 42 and therefore switching off the light emitting members 41. As the glass 50 is slightly moved upwardly, the spring 33 will force the seat 30 to go upwardly thereby making the flange of the conducting pin 32 contact the electrode 42 and therefore switching on the light emitting members 41. In the meantime, the light given by the light emitting members 41 will be refracted by the protuberances 22 of the lid 20 and reflected by the mirror surfaces 21 and 12 to the glass 50 thus making the glass 50 give a fascinating and colorful light.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A refractive coaster comprising:

a bottom cover;

a circular seat mounted on said bottom cover;

a plurality of batteries fitted inside said seat;

a printed circuit board arranged on said bottom cover and electrically connected with said batteries and having an annular ring-like electrode and a plurality of light-emitting members;

a conducting pin having an immediate portion formed with a flange and having a lower end extending downwardly through said annular ring-like electrode;

a spring fitted on an upper end of said conducting pin and urging said lower end of said conducting pin to move downwardly out said bottom cover;

a bowl-shaped base made of transparent material and having an opening at a central portion thereof and a mirrored surface at an upper side thereof, said bowl shaped base being fitted in said circular seat with said light-emitting members protruding upwardly out of said opening;

a circular lid made of transparent material and arranged on said base and having a bottom side formed with a plurality of protuberances at a central portion of said bottom side, said circular lid being arranged on said bowl-shaped base;

whereby when a glass is placed on said refractive coaster, said conducting pin will be forced to move upwardly with respect to said circular seat thereby separating said conducting pin from said electrode and therefore switching off said light-emitting members, and when said glass is slightly moved upwardly, said spring will force said conducting pin to go downwardly thereby making said flange of said conducting pin contact said electrode and therefore switching on said light emitting members and meanwhile light given by said light emitting members will be refracted by said protuberances of said lid and reflected by said mirrored surfaces to said glass thus making said glass give a fascinating light.

* * * * *